United States Patent [19]

Leclercq et al.

[11] Patent Number: 5,029,400

[45] Date of Patent: Jul. 9, 1991

[54] DEVICE FOR SETTING THE POSITION OF THE CYCLINDERS OF A ROLLING MILL

[75] Inventors: Yves Leclercq, L'etang-La-Ville; André Ravenet, Les Mureaux, both of France

[73] Assignee: CLECIM, Cergy Pontoise, France

[21] Appl. No.: 363,738

[22] Filed: Jun. 9, 1989

[30] Foreign Application Priority Data

Mar. 28, 1989 [FR] France ..... 8904014

[51] Int. Cl.[5] ..... B21C 51/00

[52] U.S. Cl. ..... 33/657; 72/16; 72/21; 72/248

[58] Field of Search ..... 33/657; 72/16, 21, 248

[56] References Cited

U.S. PATENT DOCUMENTS

| | | | |
|---|---|---|---|
| 3,906,767 | 9/1975 | Tanaka et al. | 72/21 |
| 4,116,028 | 9/1978 | Okamoto et al. | 72/21 |
| 4,127,997 | 12/1978 | Quehen | 72/21 |
| 4,481,800 | 11/1984 | Ruhl | 72/21 |
| 4,793,071 | 12/1988 | Steinseifer et al. | 33/657 |

*Primary Examiner*—William A. Cuchlinski, Jr.
*Assistant Examiner*—William C. Dowling
*Attorney, Agent, or Firm*—Pollock, Vande Sande & Priddy

[57] ABSTRACT

Device for setting of the position of the cylinders of a rolling mill whose gripping is regulated by hydraulic jacks. The device essentially comprises a tubular sleeve which surrounds a measuring rod, making no contact therewith, and moves in the same manner as the latter, being fixed to one of the elements of the hydraulic jack for gripping the cylinders of rolling mills, and sliding in an aperture pierced in the other element of the jack.

6 Claims, 3 Drawing Sheets

DEVICE FOR SETTING THE POSITION OF THE CYCLINDERS OF A ROLLING MILL

FIELD OF THE INVENTION

The invention relates to an improvement in devices for setting the position of a rolling mill during rolling.

BACKGROUND OF THE INVENTION

A rolling mill, particularly one intended for processing metal materials, comprises a cage within which are placed at least two cylinders, and often more than two, aligned vertically along a gripping plane. The product to be processed, for example a metal strip or bar, is constrained to pass between two working cylinders serving to reduce its thickness and connected for this purpose, either directly or via other cylinders called support cylinders, to one or more control members which determine their vertical displacement along the vertical uprights of the cage in order to adjust their spacing, when idle or under load, as a function of the thickness of the product being rolled, i.e., to effect appropriate gripping.

A rolling mill of the type called "quarto", for example, comprises two working cylinders bearing respectively on two support cylinders. In a rolling mill of the "sexto" types intermediate cylinders are interposed between the working cylinders and the support cylinders.

The cage of the rolling mill normally comprises two vertical uprights connected by a crosspiece on which the gripping means bear. Each cylinder is supported by a shaft rotating, at both of its ends, in bearings mounted in a piece forming a bearing block, called a "chock", and able to slide, in the gripping plane, within the corresponding upright of the cage.

The gripping of the cylinders can be effected by mechanical devices of the type having a movable screw and fixed nut, in which the screw is moved by a toothed wheel of a reducing motor assembly of conventional type. However, it is generally preferred to use a hydraulic gripping device comprising at least two hydraulic jacks placed at the level of the two uprights of the cage and bearing on one side on the upright and on the other side on the chock of the corresponding cylinder, for example the upper support cylinder in the case of a quarto rolling mill.

Each jack comprises a plunger piston forming a hydraulic piston, and a body surrounding the piston and forming a shell defining a chamber of variable volume which is fed with fluid under pressure, the piston and body being able to slide axially one relative to one another. The body can be fixed and the piston movable, or vice versa, depending on the embodiment. In the first case, the movable piston bears, with its end opposite the pressure chamber, on the corresponding chock, and in the second case it is the movable body which bears directly on the chock.

A hydraulic gripping device possesses numerous advantages relative to the former screw devices. In particular, the hydraulic gripping device makes it possible to take more rapid action and to compensate virtually instantaneously the yielding of the cage, i.e., the movement apart of the rolling cylinders brought about by the engagement between these cylinders of the product to be rolled.

Furthermore, some time ago, very efficient systems were developed for adjusting the gripping and also compensating the various deformations, such systems requiring simple and accurate monitoring of the displacements of the movable element of the jack and of the chock. For this purpose, use is made of position sensors connected to hydraulic and electro-hydraulic elements forming the control circuit of the hydraulic gripping device.

In order conveniently to effect and monitor the measurements, it is logical to place the position sensor outside the cage, above the upper part of the corresponding upright. The sensor is then connected to the chock, whose position it monitors by means of a measuring rod, of constant length, which runs in a bore made within the upright or the crosspiece. In order to effect the measurement with accuracy, it is preferable for the rod to be placed in the axis of the jack and, as its end has to be connected to the movable part of the jack, it is caused to pass successively, via suitable apertures, through the upper part of the upright of the cage and the first and then the second member of the jack, before reaching the chock to which it is fixed by an attachment piece. As the rod passes through the chamber of the jack, it is necessary to ensure sufficient leak-tightness to resist the very high pressures existing in the jack, and for this purpose use is generally made of gaskets forming a sealing joint and placed at two levels in the apertures for the passage of the rod made on the two elements of the jack. In the most common embodiments such gaskets are arranged in the actual wall of the two elements of the jack and the rod is in permanent friction against these gaskets.

However, the measuring rod must accurately transmit to the position sensor the displacements, even minimal displacements, of the chock in question, and it must furthermore possess sufficient lateral flexibility for the measurement not to be falsified by the stresses exerted on the chock.

The arrangement adopted for the assembly of the measuring rod must therefore simultaneously meet a number of conditions in order for the measurement to be performed with accuracy.

The arrangements used to date apparently gave satisfaction, but it has recently been found that the requirements of accuracy in setting the position of the cylinders had become such that any disturbances, even very minimal disturbances such as, for example, the friction exerted by the sealing gasket, were capable of influencing the measurement.

SUMMARY OF THE INVENTION

The present invention therefore relates to a novel arrangement making it possible to meet the conditions indicated above without its being possible for any disturbance, particularly caused by the deformations of the cylinders and the maintenance of the seal, to effect the accuracy of the measurement.

The invention therefore relates, in a general manner, to a device for setting the position of the cylinders of a rolling mill comprising a cage comprising two vertical uprights, at least two superposed cylinders in a gripping plane and adjustable means for gripping the cylinders, each of the latter being supported, at both its ends, by two chocks which are mounted to slide parallel to the gripping plane in two guide windows provided respectively in the two uprights of the cage, and the means for gripping the cylinders comprising, for each chock, at least one hydraulic jack centered in the gripping plane and comprising two constitutive members mounted to slide one within the other and defining between them a chamber connected to means for supplying a fluid under pressure, respectively a fixed member bearing on the cage and a movable member bearing on the chock to be monitored, each upright of the cage being provided with a device for setting the position of the chock to be monitored, comprising a measuring rod arranged along the axis of the gripping jack, between an inner end fixed to the movable member of the jack and an outer end connected to a position sensor fixed to the appropriate upright of the cage, towards the outside of the latter, said measuring rod passing into aligned apertures made respectively in the appropriate upright and at least in the fixed element of the jack, passing through the chamber of the jack in a manner sealed against the pressure prevailing in the said chamber.

According to the invention, the part of the measuring rod passing through the pressure chamber is threaded into a tubular sleeve extending between the two constitutive members, fixed and movable, of the jack over a length greater than the travel of the jack and one end whereof is connected in a leaktight manner to, and fixed for the purpose of displacement with, the corresponding member of the jack, whereas its other end is mounted to slide, over a length greater than the travel of the jack, along the inner wall of an aperture in the other element of the jack, a sliding joint being interposed to ensure tightness to the pressure in the chamber.

Moreover, in a particularly advantageous embodiment, at least one of the ends of the tubular sleeve is connected in a leaktight manner to the corresponding member of the jack in an articulated manner permitting the axis of the sleeve to move out of alignment relative to the axis of the member of the jack.

For this purpose, each articulated end of the sleeve can be threaded in a bore in a corresponding member of the jacks and is provided with a collar having a rounded lateral face, bearing on the inner face of said bore with the interposition of a sealing ring.

According to another particular feature of the invention, the end of the tubular sleeve facing inwards is connected to the movable member of the jack by a support piece in both directions of displacement, comprising an annular recess surmounting the rounded collar.

According to another embodiment of the invention, the body of the jack is fixed to the horizontal part of the appropriate upright of the rolling mill cage, while the piston, which here forms the movable member of the jack, is fixed to the appropriate chock, as are the sleeve and the rod.

According to another embodiment of the invention, the piston of the jack is fixed to the horizontal part of the upright of the rolling mill cage, while the body of the jack, which here forms its movable member, is fixed to the appropriate chock, as are the sleeve and the rod.

The invention therefore makes it possible, by use of a tubular sleeve having no contact with the measuring rod, to dissociate the sealing function from the measuring function and to isolate the measuring rod from the sealing members, which makes it possible to effect measurements with great accuracy.

BRIEF DESCRIPTION OF THE DRAWINGS

In order to ensure better understanding of the invention, a description will be given hereinafter, by way of example, of two embodiments of the device according to the invention.

DETAILED DESCRIPTION OF PREFERRED EMBODIMENTS

Figure 1:
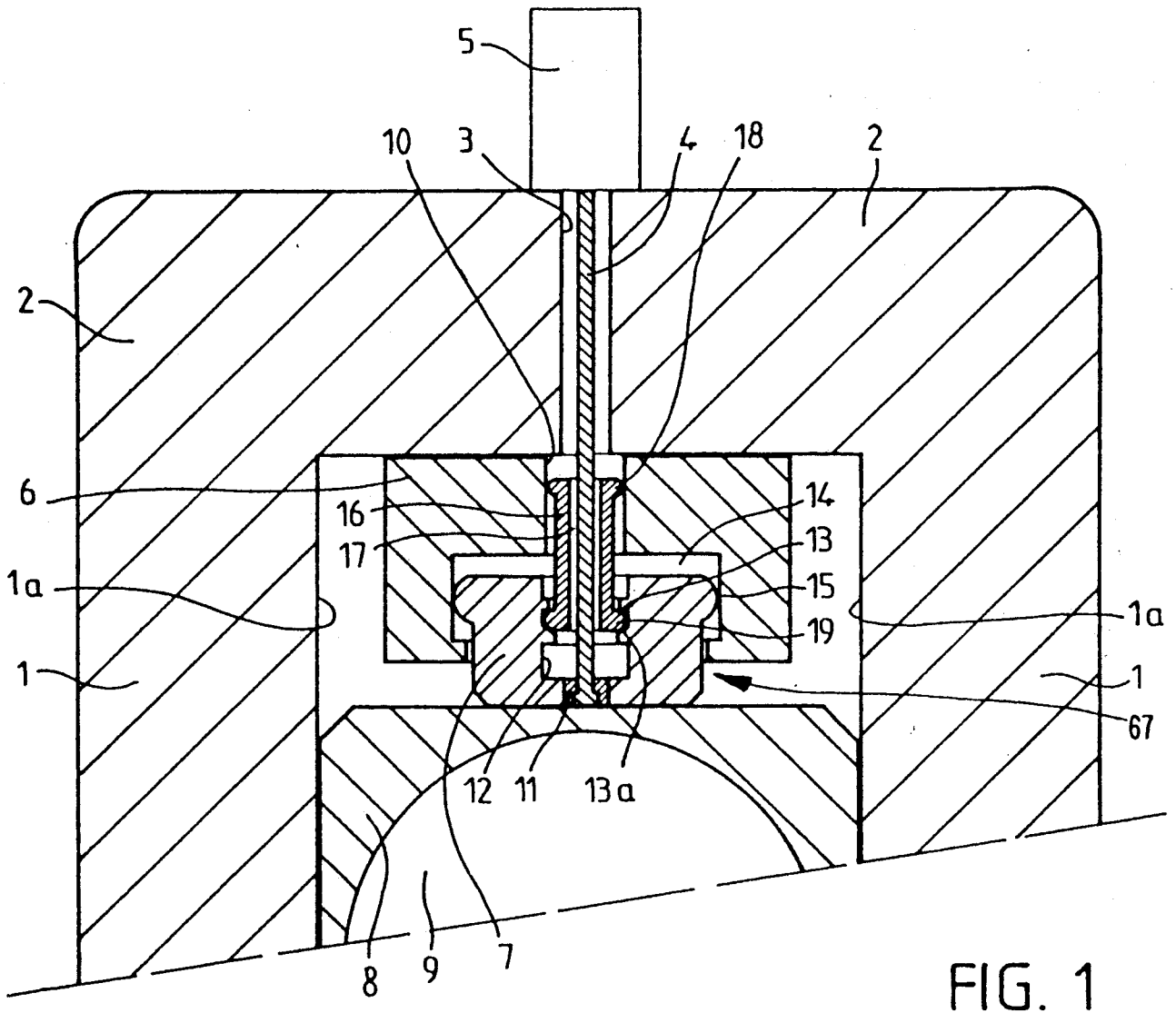
FIG. 1 is a diagrammatic schematic front elevation in vertical cross-section, of the first embodiment in which the piston of the jack is secured to the chock, the sleeve being secured to the movable piston and sliding in the body of the jack.

FIG. 1 shows in a section transverse to the axis of the cylinders, the upper part of the cage of a rolling mill comprising two uprights 1 connected by a crosspiece 2 and defining a window in which the chocks of the cylinders are mounted for sliding movement. In the figure, only an upper support cylinder 9 associated with the chock 8 has been shown.

The gripping of the cylinders is effected, in a conventional manner, by two hydraulic jacks bearing on one side on the crosspiece 2 and on the other side, in each case, on a chock 8.

Thus, in the embodiment shown in FIG. 1, the gripping jack comprises a body 6 fixed to the lower face of the crosspiece 2, within which body a piston 7 is slidably mounted and bears, with its lower face, on the chock 8 of the cylinder 9. The jack body 6 and the piston 7 define between them a pressure chamber 14 connected to means for supplying a fluid under pressure which are easy to conceive and are not shown in the drawing. A sealing joint 15 is interposed between the inner face of the jack body 6 and the outer face of the rear end of the piston 7 which can thus move between two extreme positions along the inner wall of the body 7 of the jack 67.

In this manner, the chock 8 can move vertically, within the window la of the cage, under the action of the piston 7 of the jack 67.

To monitor the operation of the rolling mill, in particular the forces applied to the chocks, the position of each of the latter is set by means of a displacement sensor 5 mounted on the outer face of the crosspiece 2 and connected to the corresponding chock 8 by a measuring rod 4 whose end opposite the sensor 5 is connected to the movable member of the jack, that is to say, in the case of FIG. 1, to the piston 7. The rod 4 must therefore pass through all the members interposed between the sensor 5 and the piston 7, and for this purpose passes into aligned apertures, respectively a bore 3 made in the crosspiece 2 and a bore 10 made in the fixed member of the jack, that is to say, in the case in question, the body 6. Moreover, to avoid any error resulting from the deformation of the components under the action of the stresses applied, the lower end of the rod 4 is fixed as close as possible to the chock 8, which is why there is also made, in the movable member formed by the piston 7, a passage aperture 12 for the rod whose lower end is fixed by an attachment piece 11 closing the aperture 12 at the bottom and positioned substantially at the level of the bearing face of the piston 7 on the chock 8.

The aligned passage apertures 3, 10, 12 for the rod all have a diameter greater than the thickness of the rod in a manner such that the latter can move freely.

Moreover, at the level of the jack 67, the rod 4 passes with play into a tubular sleeve 16 intended to ensure leaktightness while following the displacements of the rod but without contacting the latter. For this purpose, the sleeve 16 is connected at one end to one of the members of the jack and its other end passes within the aperture made in the other member of the jack and over a length at least equal to the travel of the latter.

For example, in the embodiment shown in FIG. 1, the rod 4 is surrounded by a tubular sleeve 16 which is threaded into the two apertures 10 and 12 made respectively in the body 6 and the piston 7.

Moreover, at least one of the ends of the tubular sleeve 16 is connected in a leaktight manner to the corresponding member of the jack and with the possibility of articulation, permitting any movements out of alignment, in a manner such as to give the assembly the suitable lateral flexibility for the measurements made by the rod 4 not to be affected, if desired, by the deformations of the various members under the action of the stresses applied.

In the embodiment of FIG. 1, such a leaktight and articulated connection is made at both ends of the tubular sleeve 16. The latter comprises, in fact, a cylindrical central part provided, at each of its ends, with a widened part in the form of a collar which makes contact with the inner face of the corresponding aperture via a gasket forming a sealing joint. The upper collar 18 slides in the aperture 10 of the body 6 of the jack 67 and thus has exactly the diameter of this sleeve, while the lower collar 19 is fixed for the purpose of axial displacement to the movable piston 7, in a manner which will be described hereinafter with reference to FIG. 2.

In this first embodiment of the invention, the piston 7 of the jack, the sleeve 16 and the measuring rod 4 form, together with the chock 8, an assembly which is integral for the purpose of displacement, while the body 6 of the jack and the position sensor 5 are fixed to the upper crosspiece 2 of the upright 1 of the cage and thus do not move.

Figure 2:
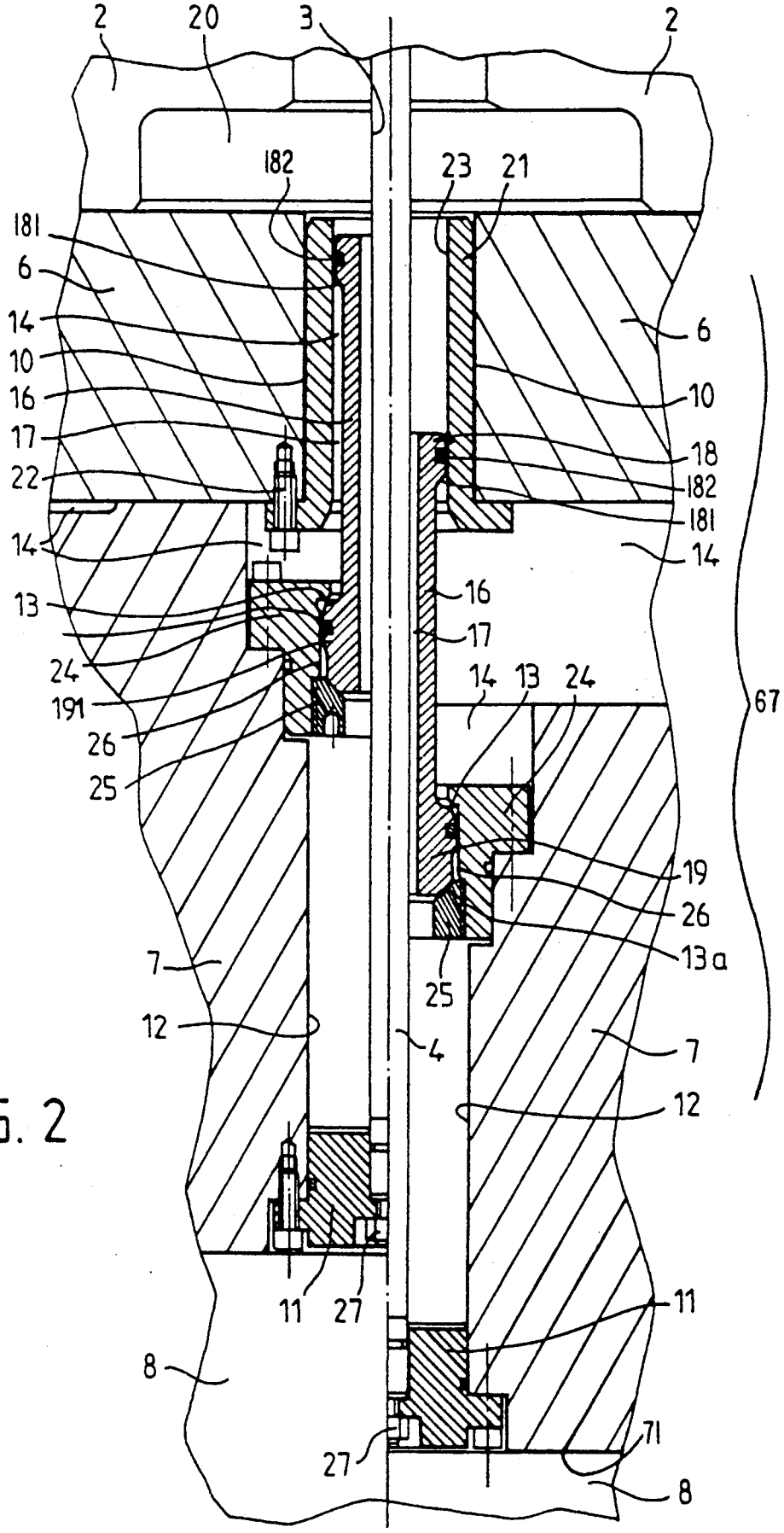
FIG. 2 is a more detailed illustration, in vertical cross-section, of the central portion of FIG. 1.

FIG. 2 is a more detailed view of the first embodiment, namely of the central part of the assembly formed by the body 6 of the jack, its piston 7, the tubular sleeve 16 and the lower end of the measuring rod 4. The part shown to the left of the vertical axis of the figure corresponds to the upper position of the piston 7, of the sleeve 16, of the rod 14 and of the chock 8, whereas the part shown on the right of this axis corresponds to their lower position.

The body 6 of the jack is fixed to the upper crosspiece 2 of the upright of the cage by means of a piece 20, into which the aperture 3 made in the crosspiece 2 is extended.

The aperture 10 pierced in the body 6 is fitted with a metal bush 21, fixed to the body 6 by bolts such as 22. This bush can be changed in the event of wear. Along its inner wall 23 slides the upper collar 18 of the tubular sleeve 16 fitted with a sealing gasket 182.

The piston 7 of the jack bears with its lower face 71 on the upper face of the chock 8. It is pierced by a cylindrical bore 12, in the upper part of which is placed a support piece 24 fixed to the piston 7 and having a circular inner rim 13. The lower collar 19 of the tubular sleeve 13 is wedged against this rim 16 by means of a tightening wedge 25. The lower collar 19 is supported along the inner face 26 of the piece 24 by means of a sealing gasket.

At the bottom of its bore 12, the piston 7 is fitted with a piece 11 for attaching the lower end 27 of the measuring rod 4. The two shoulders 18 and 19 of the sleeve 16 fitted with sealing joints form leaktight articulated connections providing some possibility of moving the sleeve 16 out of alignment relative to the rod 4, on the one hand, and relative to the piston 7 on the other hand.

Thus the measuring rod 4, the tubular sleeve 16, the piston 7 and the chock 8 form, in this embodiment, an integral assembly whose displacements are measured accurately by the position sensor connected to the upper end of the measuring rod, the latter being subjected only to the vertical displacements of the piston and of the chock and unaffected by any external disturbances. The displacements can take place between two extreme positions, the upper position, shown to the left of the vertical axis in FIG. 2, and the lower position, shown to the right of the vertical axis in FIG. 2.

Figure 3:
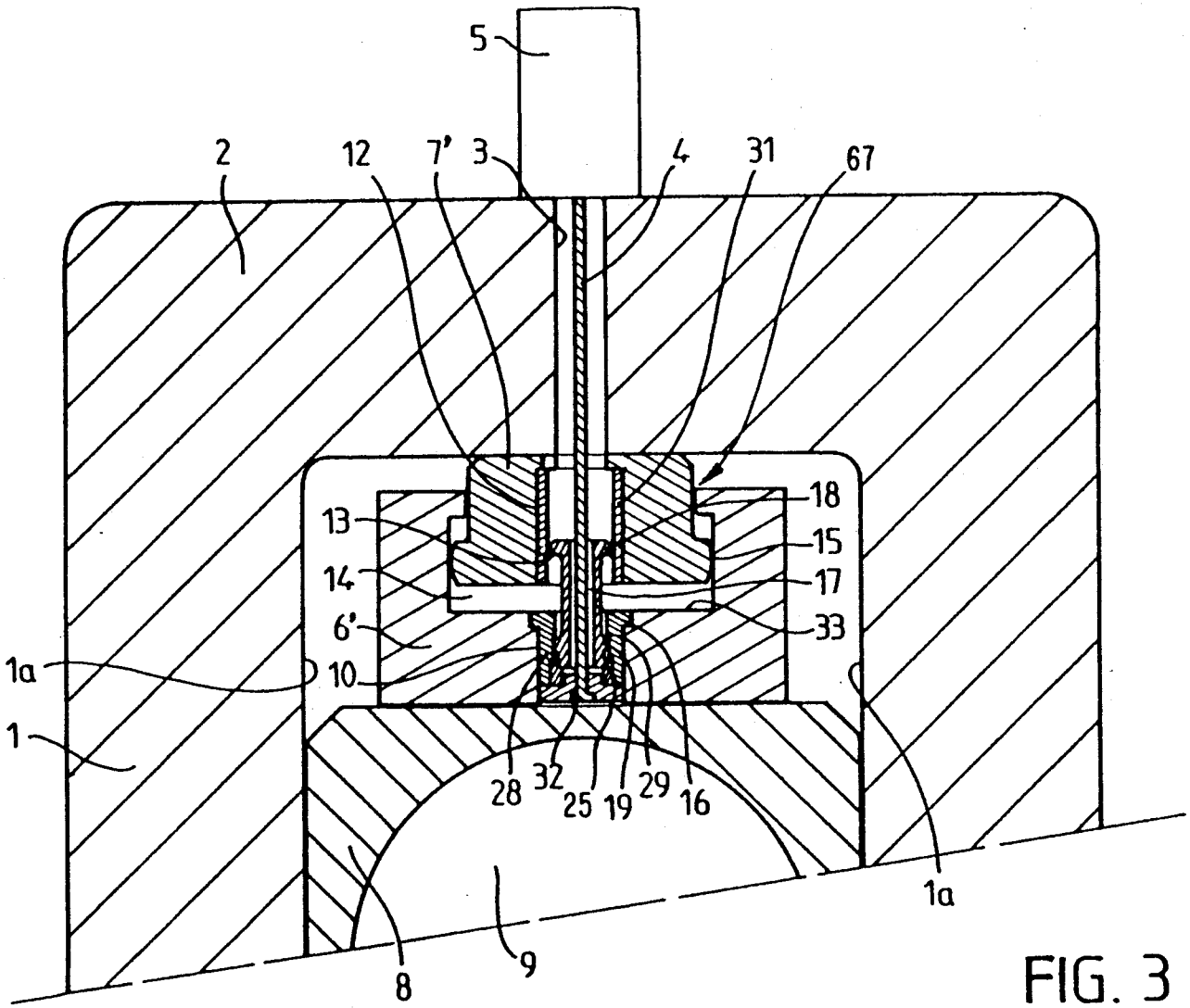
FIG. 3 is a schematic front elevation in vertical cross-section, of the second embodiment in which the body of the jack is fixed to the chock, the sleeve being locked in the body of the jack and sliding in the fixed piston.

FIG. 3 is a vertical section of a second embodiment of the device according to the invention, in which the body 6' of the jack is fixed to the chock 8, the lower end of the tubular sleeve 16 being locked in the body of the jack, which is movable with the chock and the measuring rod, while the other end of the sleeve slides in an aperture of the piston of the jack, fixed to the upper crosspiece of the cage.

In FIG. 2, the body 6 of the jack, which bears on the chock 8 and moves therewith, is pierced by an aperture 10 fitted with a metallic bush forming a support piece 24, provided with an inner circular rim 13 against which the lower collar 191 of the tubular sleeve 16 is locked from bottom to top. The contact between the lower collar 191 and the inner face of the bush 24 is rendered leaktight by means of a sealing ring 192 inserted in the collar 191.

The piston 7 of the jack is fixed to the upper crosspiece 2 of the cage 1 by means which are not shown. Its bore 12 is fitted with a metal bush 31 within which the upper collar 18 of the sleeve 16, fitted with a sealing gasket, slides with gentle friction. FIG. 3 shows the movable assembly (sleeve, body, chock and measuring rod) in the low position. The lower end of the rod 4 is fixed on the chock 8 by means of an attachment piece 32. The chamber 14 of the jack is supplied with fluid under pressure by means which are not shown.

Thus, the measuring rod 4, the chock 8, the jack body 6 and the tubular sleeve 16 form, in this embodiment, an integral assembly, whose displacements are accurately measured by the position sensor 5 connected to the upper end of the measuring rod. These displacements can take place between two extreme positions, the lower position being shown in FIG. 3, while the higher position is obtained when the circular upper part 33 of the body of the jack comes to bear against the crosspiece 2 of the upright of the cage. This upper position is normally not achieved.

As can be clearly seen from the description of these two examples, the tubular sleeve moves in the same manner as the measuring rod, but with no contact therewith. Hence the three advantages of the invention mentioned above: accuracy of the position measurement, lateral flexibility of the measuring rod and leaktightness.

The invention applies to all types of hydraulic jack for gripping the cylinders of rolling mills.

We claim:

1. In a rolling mill comprising (a) a housing having two vertical uprights respectively provided with guide windows;

(b) at least four rolls, respectively two working rolls and two backup rolls, said rolls being superposed along a vertical plane and each having ends supported by chocks mounted for sliding movement parallel to said vertical plane into said guide windows;

(c) adjusting means for gripping said rolls against each other, said adjusting means comprising for each upright a hydraulic gripping jack centered in said vertical plane and comprising two constituent members, mounted for sliding movement within one another and defining between them a chamber connected to means for supplying a fluid under pressure; and (d) a fixed member bearing on said housing and a movable member bearing on the corresponding chock of an upper back-up roll;

the improvement comprising (e) a device for monitoring the position of said chock of said upper back-up roll, said device comprising:

(i) a position sensor fixed to the corresponding upright of said housing towards the outside of said housing;

(ii) a measuring rod arranged along the axis of said gripping jack, between an inner end fixed to the movable element of said jack and an outer end connected to said position sensor, said measuring rod passing into aligned apertures made respectively in said upright and in the fixed element of said jack and passing through said pressure chamber;

(iii) a tubular sleeve extending into said chamber between said fixed member and said movable member of said jack and having a length greater than the travel of said jack, said measuring rod passing with play into said sleeve;

(iv) said tubular sleeve having two ends respectively engaged in said aperture of said fixed member and in a bore provided in said movable member, said aperture and said bore having an inner cylindrical face;

(v) each engaged end of said sleeve being provided with a collar having a rounded lateral face bearing respectively on said inner face of said aperture and on said inner face of said bore, with the interposition of a sealing ring;

(vi) one end of said sleeve being connected to one member of said jack, the other end of said sleeve being mounted for sliding movement along said inner cylindrical face of the other member of said jack, over a length greater than the travel of said jack; and (vii) said two ends of said sleeve each providing an articulated and leaktight connection, respectively with said fixed and said movable members of said gripping jack for permitting disalignments.

2. The combination claimed in claim 1, wherein the end of the tubular sleeve facing inwards is connected to the movable member of the jack by a support piece in both directions of displacement comprising an annular recess surmounting the collar.

3. The combination claimed in claim 1, wherein the body of the jack is fixed to a horizontal part of the appropriate upright of the rolling mill cage, whereas a piston forming the movable member of the jack bears on the corresponding chock of the relative roll.

4. The combination claimed in claim 1, wherein the piston of the jack is fixed to a horizontal part of the upright of the housing, whereas the body of the jack which forms the movable member thereof bears on the corresponding chock of the associated roll.

5. The combination claimed in claim 1, wherein the gripping means bears on an upper crosspiece of said housing and wherein said position sensor is arranged on the outside of said crosspiece and is connected by measuring rod to one of the chocks of the upper support roll of the rolling mill.

6. The combination claimed in claim 1, wherein the gripping means and the position sensor are arranged in a lower part of the upright of said housing, and wherein the measuring rod is connected by its upper end to the corresponding chock of the lower support roll.

* * * * *